US008693609B2

(12) United States Patent
Foppe

(10) Patent No.: US 8,693,609 B2
(45) Date of Patent: Apr. 8, 2014

(54) METHOD OF AND APPARATUS FOR FINAL STORAGE AND SAFE OPERATION OF A NUCLEAR-POWER STATIONS

(75) Inventor: Werner Foppe, Geilenkirchen (DE)

(73) Assignees: Werner Foppe, Geilenkirchen (DE), part interest; Franz Josef Rademacher, Ulm (DE), part interest ( * ) Notice: Subject to any disclaimer, the term of this patent is extended or adjusted under 35 U.S.C. 154(b) by 1077 days.

(21) Appl. No.: 12/294,260

(22) PCT Filed: Mar. 23, 2007

(86) PCT No.: PCT/EP2007/002613

§ 371 (c)(1),
(2), (4) Date: Feb. 21, 2009

(87) PCT Pub. No.: WO2007/110211

PCT Pub. Date: Oct. 4, 2007

(65) Prior Publication Data

US 2009/0145659 A1 Jun. 11, 2009

(30) Foreign Application Priority Data

Mar. 24, 2006 (DE) ..... 10 2006 013 836

(51) Int. Cl.
*G21C 19/00* (2006.01)

(52) U.S. Cl.
USPC ..... 376/272; 376/274

(58) Field of Classification Search
USPC ..... 376/272, 273, 274, 275, 276, 588; 175/57, 67, 11; 37/411
See application file for complete search history.

(56) References Cited

U.S. PATENT DOCUMENTS

| | | | | |
|---|---|---|---|---|
| 3,357,505 | A | 12/1967 | Armstrong | 175/16 |
| 5,022,788 | A * | 6/1991 | Baird | 405/129.35 |
| 5,148,874 | A | 9/1992 | Foppe | 175/11 |
| 6,591,920 | B1 * | 7/2003 | Foppe | 175/67 |

FOREIGN PATENT DOCUMENTS

| | | | |
|---|---|---|---|
| DE | 3001348 | 7/1981 | |
| DE | 19501437 | 9/1996 | |
| DE | 19528496 | 10/1996 | |
| DE | 19721188 | 5/1999 | |
| EP | 1517337 | 3/2005 | |
| EP | 1517337 A1 * | 3/2005 | G21F 9/34 |

OTHER PUBLICATIONS

Kosachevski et al., Self-burial of radioactive waste, XP-000932150, American Institute of Physics, New York, vol. 44, No. 11, Nov. 1999, pp. 1377-1381.*

(Continued)

*Primary Examiner* — Timothy A Brainard
(74) *Attorney, Agent, or Firm* — Andrew Wilford

(57) ABSTRACT

Highly radioactive material is permanently disposed of by first forming a borehole by a metal fusion drilling method with a metal lining from a casting continuously formed from a metal melt and then depositing the highly radioactive material for final storage in a lower area of the lined borehole. This lining is melted locally immediately above this lower area after deposition of the material to separate the lower area holding the material from the rest of the lining and permit this lower area and the material held therein to migrate automatically downward toward the center of the earth. To promote this downward migration, the wall thickness of the metallic lining of the lower borehole region has a wall thickness that increases from the top downward and on the lower area is formed with a downwardly directed conical tip.

13 Claims, 1 Drawing Sheet

(56) References Cited

OTHER PUBLICATIONS

Hollister et al., Burial of Radioactive Waste under the Seabed, XP-000739045, Scientific American, Jan. 1998, pp. 40-45.*
Althaus E et al: Das kontinentale Tiefbohrprogramm and die Fluidforschung:, Geowissenschaften 13, 1995, 4, pp. 47-153.
Gibb F G F:"High-temperature, very deep geological disposal: a safer alternative for high-level radioactive waste?" Waste Management, Elsevier, New York, vol. 19, No. 3, Jun. 1999, pp. 207-211, p. 207, p. 209.
Kosachevskii L Y et al: "Self-burial of radioactive waste" Soviet Physics Technical Physics, American Institute of Physics, New York, vol. 44, No. 11, Nov. 1999, pp. 1377-1381.
Hollister C D et al: "Burial of radioactive waste under the seabed" Scientific American, Scientific American Inc., New York, vol. 278, No. 1, Jan. 1998, pp. 40-45.

* cited by examiner

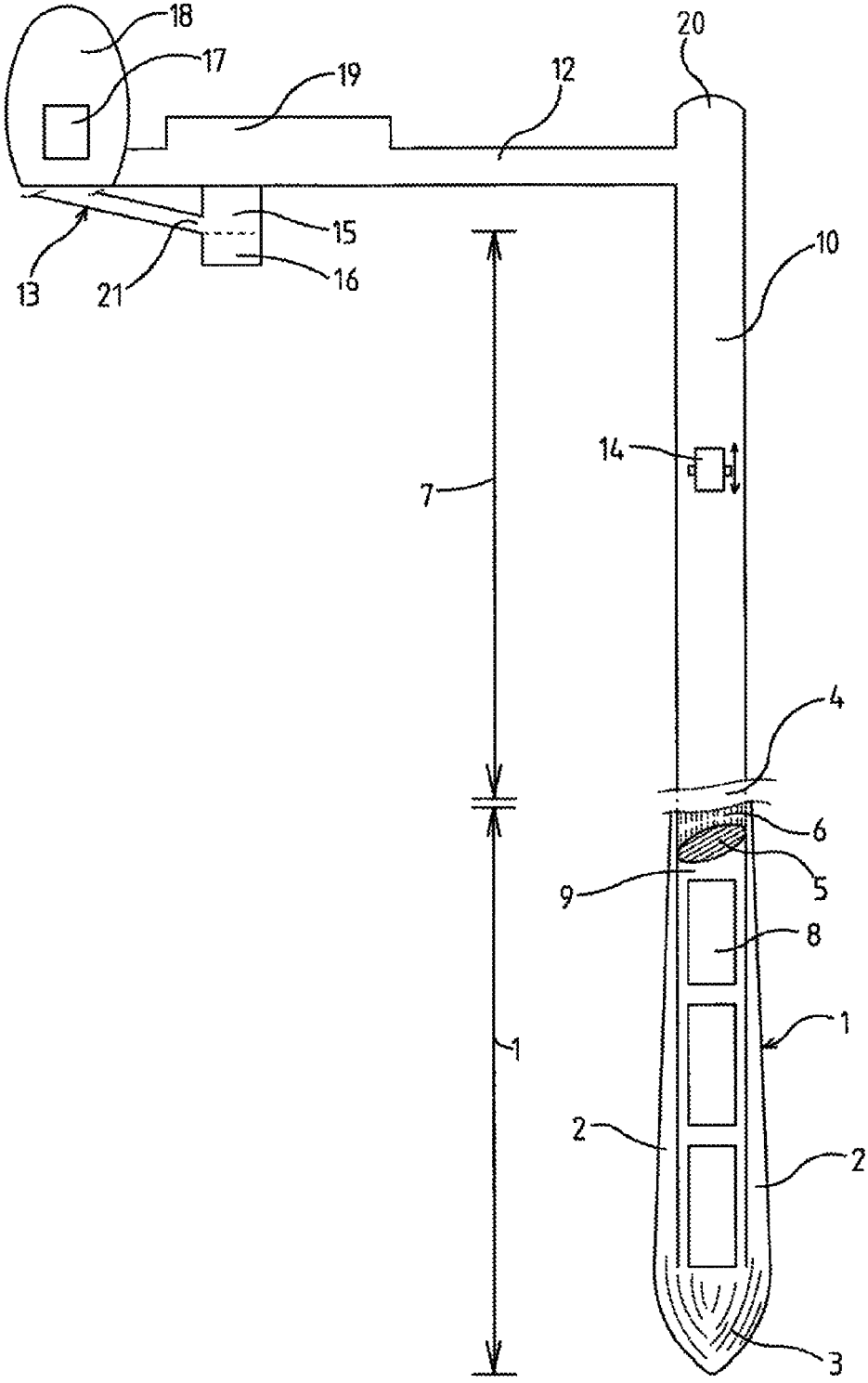
18
17
19
12
20
15
16
13
21
10
14
7
4
6
5
9
8
1
1
2
2
3

METHOD OF AND APPARATUS FOR FINAL STORAGE AND SAFE OPERATION OF A NUCLEAR-POWER STATIONS

CROSS REFERENCE TO RELATED APPLICATIONS

This application is the US-national stage of PCT application PCT/EP2007/002613, filed 23 Mar. 2007, published 4 Oct. 2007 as WO2007/110211, and claiming the priority of German patent application 102006013836.8 itself filed 24 Mar. 2006, whose entire disclosures are herewith incorporated by reference.

FIELD OF THE INVENTION

The invention relates to a method of creating a safe permanent depository in a borehole produced by fusion drilling and having a lining formed by solidified melt, in particular a metallic lining. The invention further relates to an apparatus for creating a safe permanent depository comprising at least one borehole with a lining, in particular a metal lining from a casting. The invention should be used in particular for final storage of highly radioactive and/or highly toxic material, but is also suitable for storage of any other material.

The invention further also relates to apparatuses as safe and cost-effective permanent depositories for low-level and medium-level radioactive materials and a bomb-proof holding and transport system for use between reactor or intermediate storage facility and a permanent depository shaft. The invention furthermore relates to apparatuses for controlling of a reactor core meltdown and automatic direct final storage of the molten core that has leaked out.

BACKGROUND OF THE INVENTION

The driving of boreholes, in particular so-called super-deep boreholes with bore diameters of constant size as far as the drilling target and in particular at depths of up to 20 km or more is known, for example, from EP 1 157 187 [U.S. Pat. No. 6,591,920] of the instant applicant, the content of which is integrated herein by reference in its entirety. The method described here can preferably be used in order to produce a borehole by fusion drilling and thereby provide the borehole with a seamless lining, in particular of metal.

SUMMARY OF THE INVENTION

To this end, a melt, of a pure metal or also of a metallic alloy, is fed as a drilling medium through pipeline elements to the base of the borehole to be lined with the melt, the melt being forced into the surrounding rock that is fractured in particular due to the effects of temperature and pressure, and a metallic lining is produced during boring by the solidifying metal melt.

For this purpose, the in particular pure metal melt coming out of the lowermost pipeline element of the metal fusion drilling facility at the base of the borehole can be guided between the outer surface of the metal fusion drilling equipment, in particular the lowermost pipeline element thereof, and the inner wall of the borehole, and solidify there. As the boring progresses, further pipeline elements can be attached to the previous element in order to thus continuously drive the bore deeper. As pipeline elements, in particular in the hot area, graphite can be used. Thus pipeline elements, in particular in the upper cooled area, can work as magnetic slides that slide along the metallic lining, in particular in a controlled manner, and preferably can withstand horizontal as well as vertical thrust forces both downward and upward.

The driving of fusion boreholes is carried out only preferably by this known method, however, other methods can also be used if they are suitable for producing a lining, in particular a cast one.

The safe final storage of highly radioactive materials is a socially serious problem that is still unresolved on a worldwide level. There has not hitherto been a safe permanent depository concept in any country, although hundreds of billions of Euros have been spend worldwide on the search for and testing of suitable permanent depository locations.

After 50 years, the nuclear-energy community with its scientific and economic potential has so far not managed to provide a safe permanent depository in any country, although the unresolved permanent depository problem, in addition to the irrefutable reactor residual risk, has the greatest influence on the decline of the nuclear-energy market share in world energy production.

According to current permanent depository concepts and methods for dismantling nuclear-energy plants and nuclear facilities, their dismantling and the final storage of the contaminated material resulting therefrom is more expensive than the construction of the plants themselves, so that the search for the "best possible permanent depository" should bring a higher savings potential with a simultaneous increase in safety.

Unjustifiable method proposals, such as making deep-sea holes or sending to the moon or into space, are already ruled out for safety reasons and are not under discussion.

Almost every country with nuclear technology is engaged in developing or constructing its own final depository concepts and apparatuses. The USA is working on a final depository in the tuff of the Yucca Mountains not far from Las Vegas. Canada, Sweden, Switzerland and others are investigating hard rock (crystalline) as a final depository.

The German final depository concept is designed for salt as host rock, at least up to the start of the current moratorium for the Gorleben salt dome, which will run through the year 2010 at the latest and is to be used to search for a "best possible final depository" in different host rocks.

The objective is to have a serviceable final depository available by 2030, it being assumed that after the resolved phase-out of nuclear-power plants, all highly radioactive materials accruing through 2080 will be stored in a final depository.

All of the concepts in the different countries have in common the driving of a mine-like tunnel system as a central depository with large capacity at depths of a maximum of approx. 1000 m, which thus remains in the range of the biosphere. There is a danger that over longer periods of time ground water, surface water and deep water after tectonic changes will be able to penetrate and contaminate the biosphere.

There is widespread agreement in Germany among the responsible parties that both the Gorleben salt dome and the "Schacht Konrad" ore mine near Salzgitter can be used at most as a final depository for low-level and medium-level radioactive material, which with an estimated 280,000 $m^3$ also accounts for 90% of the radioactive material for final storage through 2080, if the agreed phase-out is upheld.

The search for the "best possible" final depository in Germany, in particular for highly radioactive materials, thus has a higher priority on the agenda and moreover can become a multi-billion mega-market for the German economy.

The decisive factor for the option of a central final depository are the high exploration and construction costs for shaft construction and the underground tunnel and caverns, since the development costs would then need to be spent only once. At the same time, according to the current final depository costs, suitable locations are few on the ground in terms of geology.

Factors against a central final depository are the risks during transport and unloading from the transport containers in the final depository as well as the high transport costs and the resistance among the general public to the transports and against the central location, since no one wants to have the long-life and possibly deadly waste from others in his neighborhood.

In the international agreement on final storage with the signing of the Joint Convention on the Safety of Spent Fuel Management and on the Safety of Radioactive Waste Management on Oct. 1, 1997, all 42 signatory states agree that the final storage of highly radioactive, long-life products from nuclear energy should be carried out outside the biosphere safely in deep geological formations with the shortest possible transport routes.

Known methods for the final storage of highly radioactive material in pressure-resistant apparatuses by driving them into the interior of the earth utilize the subduction zone where the stored material disappears in the mantle of the earth with the subtending tectonic plate over the course of millions of years. One possibility of final storage in subduction zones that can be realized with given technology was given only there, as set forth, for example in U.S. Pat. No. 5,022,788, where the subduction zone is close to the surface and can be reached from the continental crust through boreholes or tunnels in order to also be able to store significant quantities.

The final storage of radioactive material enclosed in pressure- and heat-resistant containers is not technically possible with conventional drilling technology (KTB: the continental deep drilling program of the Federal Republic of Germany), and shaft construction up to a depth with viscous deep-seated rock, as postulated in DE 195 28 496. The known continental deep drilling (KTB) in the Upper Palatinate reached its end technically and in terms of mineral geology at 300° C. rock temperature at a depth of 9000 m. From 300° C. and in particular in the presence of water, the stability of the rock decreases so much that the exposed, unlined borehole or shaft area collapses from the side under the pressure of the side rock. (*Geowissenschaften*, Vol. 13, April 1995, pages 151-153).

OBJECT OF THE INVENTION

The object of the invention is to overcome these disadvantages and to comply with the demand for the "best possible final depository." The object of the invention is furthermore to provide a method and apparatus that offer a safe and cost-effective final depository directly on site and can be used in all countries, and in particular furthermore offer the possibility in the case of the burnthrough of a reactor of thus controlling the reactor core meltdown without polluting the environment.

SUMMARY OF THE INVENTION

This object is attained according to the invention by a method in which in particular subcritical highly radioactive material for final storage is deposited in a lower area of the lined borehole, this lower area being separated after being filled from the rest of the borehole so that it subsequently moves independently toward the center of the earth.

The object is further attained in that in a permanent depository apparatus at least one lower borehole region (1/7) of a lined borehole after filling with final depository material, in particular in subcritical condition, can be separated/is separated from the rest of the borehole, in order to sink as a result of autogenous heat generation and/or rock pressure and/or permanent weight under the effect of gravity and/or magma formation toward the center of the earth.

As mentioned at the outset, the metal melt drilling method according to EP 1 157 187 represents a technically realizable drilling method with which in a continuous fusion drilling process production-ready extremely deep bores with large dimensionally stable borehole diameter can be produced quickly and cost-effectively up to depths of 20 km or more. With the continuous advance of the fusion drilling installation, in particular by magnetic slides, at the same time a seamless die-cast lining is produced from the metal melt acting as a drilling mud, which lining serves the magnetic slide as a "reaction rail" and transportation tube. These boreholes lined by die-casting, whether produced by this or another process, are used according to the invention as final depository.

With the cited metal melt-drilling method running continuously at no time is an exposed, unlined borehole region present, since a strong-walled metal lining is directly constructed from the metal melt, which also serves as a "drilling head." The stability of a borehole or borehole lined in this manner depends on the thickness of the metal wall, the prevailing pressure difference between the inner and outer wall and in particular the prevailing temperature. A borehole metal-lined in this manner can remain stable up to the rock temperature range of at least 600° C.-700° C., so that depths of around 20 km in the continental crust are to be expected. However, even under these temperature and pressure conditions the deep-seated rock is not present in a viscous form, but in a solid, albeit ductile form.

The bore is preferably produced up to a depth at which the rock is ductile and in particular partial melts already form, the formation of which is further intensified by the autogenously generated heat of the embedded, heat-generating, highly radioactive material or in which in particular under the given temperature and pressure conditions, in the hot deep-seated rock the rock crystals are displaced with respect to a free, solid and in particular heavy metal body, on which the force of gravity of the earth acts more strongly than on the surrounding lighter surrounding rock. This can thus advantageously cause an accelerated migration of a separated lower borehole region that serves as a final depository zone.

The migration speed of the entire separated lower borehole region or final depository zone is preferably promoted when the outer shape thereof is formed so as to widen downward conically so that the enormous lateral compressive forces become vertical thrust force.

This migration according to the invention of the final depository zone in the form of a heavy metal body can be given, in addition, an acceleration by reduced friction from the increased internal temperature by means of the radioactive residual heat formation and/or by fluid collection in the metal mantel/deep-seated rock border area, in particular since these fluids can be supercritical under the prevailing temperature and pressure conditions and their frictional value is therefore drastically reduced.

Advantageously, a final depository zone can slide downward in an accelerated manner under its gravitational force, surrounded by fluids or wetted by a fluid film, in particular like a glacier slides on its water film toward the valley.

According to the invention, in the lower borehole region or the highly radioactive material finally deposited in the deepest part of the shaft can be filled up with a medium, for example, with molten lead as a moderator and/or heat compensation medium and/or pressure compensation medium, or the material to be finally deposited can be filled in.

A lower borehole region thus filled up can be separated according to the invention as a final depository zone above the filling-in of the rest of the borehole by melting of the lining, in particular of the metal lining, e.g. over a length of several meters, and migrates as a whole out of the hot deep-seated rock toward the center of the earth, in particular under autogenous generation of heat and high permanent weight.

BRIEF DESCRIPTION OF THE DRAWING

The method and the apparatus are explained in more detail with reference to the sole FIGURE of the drawing.

DETAILED DESCRIPTION

According to the invention, in the direct vicinity of a nuclear-power plant 18 or an intermediate storage facility 19 at least one borehole, for example, a borehole 10 that is 20 km deep, is sunk according to the described metal fusion-drilling method. The borehole 10 has a dome 20.

An upper long region 7, e.g. more than three quarters of the borehole 10 thus produced, with in particular a continuous constant diameter, e.g. of preferably more than 0.5 meters, is provided with a lining, in particular a strong cast-metal lining preferably with good magnetic permeability, and according to the invention can be used as a final depository shaft, in order to conduct material to be stored into a lower smaller region 1, e.g. less than a quarter of the borehole 10.

The lower borehole region 1, in particular the lower quarter or less, can be used hereby as a final depository zone, e.g. for highly radioactive and/or heat-developing materials or also other material. This borehole region 1 can preferably be in a ductile rock area or in the area of supercritical fluid conditions.

Furthermore, the region 7 of the borehole lying above it can be used as a final depository for other material, e.g. for low-level and medium-level radioactive material, e.g. that accrues in the dismantling of a nuclear-power plant or another nuclear facility.

Preferably the lower region used as a final depository zone 1 in the production of the borehole 10 can be formed in the area of the cast-metal lining such that the wall thickness is greater in the lower area than in the upper area, for example starts at 0.25 m and ends at the top at 0.05 m. This region 1 filled with highly radioactive and heat-generating elements 8, for instance spent fuel elements, surrounded by a mass 9 of heat-conducting and moderating material, for instance lead.

The final depository zone 1 according to the invention can be separated from the rest of the borehole as a whole after filling with material to be finally disposed of and/or as required zone by zone, the separation of this zone 1 from the remaining zone 7 of the shaft 10 can advantageously occur by melting of a shaft wall area 4 in particular by radiation energy, which advantageously can come from a laser or a graphite emitter that can be moved upward and downward in the borehole via a magnetic slide device 14.

The separation according to the invention by melting the borehole region 4 directly above the final depository zone 1 filled with highly radioactive material and preferably cast, for example, from molten lead can preferably be carried out such that this at the same time leads to the safe capping of the separated final depository zone 1 by the accumulating metal melt, which is deposited above the final depository zone and can form a metal cover or plug 5 and/or floats directly on the molten lead and with the remaining residue of the final depository zone lining forms a solid metal plug 6.

The remaining lining-free melting area 4 in the borehole can optionally be filled up below the remaining region to form on a conical cast-iron tip 2 a new shaft tip 3 with a material (for example, borax) which promotes self-driving by migration through the hot bedrock.

According to the invention, the upper shaft portion open at the bottom after separation can be closed with a cast metal filling, which serves as a new shaft tip 3 and preferably strengthened, e.g. by alloying elements, ensures the self-driving process.

The final depository apparatus according to the invention preferably comprises a system 12 safely closed with respect to the biosphere, e.g. a transport tunnel that connects the final depository shaft 10 to the plant's reactor 17 and/or to the intermediate storage facility 19, such as, for example another magnetic slide system 14 (not shown).

The transport tunnel 12 according to the invention between the reactor 17 and the final depository shaft 10, preferably bombproof and hermetically sealed off from the outside world, preferably also makes possible the construction of a catchment 13 and final depository apparatus for the event of a reactor meltdown, which greatly reduces the residual risk in the operation of nuclear-power plants and permits substantially longer running times of the nuclear facilities, so that the "golden end" of production time is extended in a favorable manner.

The catchment and final deposition system 13 for the event of a reactor meltdown can be currently integrated into planning with new reactor constructions and thus designed in an optimal manner. With existing nuclear-power plants not provided with a ground protection of graphite tiles, an escape tunnel can preferably be built under the reactor foundation, which tunnel is preferably lined with graphite tiles and guides a reactor melt occurring unerringly into the sump 15 lying deeper, which can preferably also be lined with graphite tiles and is optionally additionally lined with special crucibles 16 of graphite such that the reactor melt flowing in is distributed in the graphite crucibles available and, after a decay time, can be conveyed via the automated transport system into the final depository.

The catchment and final deposition system according to the invention for the event of a reactor meltdown 13 can be filled up with a medium 21 that is as far as possible inert with respect to radioactive radiation, heavier than air and lighter than the reactor melt. The contamination of the catchment and final deposition system 13 is thus preferably limited, and the medium can be pumped out after the final storage of the reactor melt and likewise finally stored.

The advantages of the final storage method according to the invention with a direct permanent depository apparatus in situ on the site of nuclear facilities by means of boreholes according to the metal melt drilling method, compared to known methods and compared to a central final depository are as follows:

1. The driving and use of cost-effective permanent depository shafts for in particular highly radioactive materials directly at the location of production and/or storage saves high exploration costs in the search for and testing of suitable locations and saves valuable time, since every available location with nuclear facilities is suitable per se for the final depository method according to the invention described above, and the material to be finally stored reaches safe depths outside any influence of the biosphere.

2. The need for highly radioactive nuclear waste to travel in spite of the resistance by the general public is ended or can be restricted to marginal areas, to substantially reduce radiation exposure, the risk of accidents and the disposal costs for the general public.

3. Safe final storage of highly radioactive fuel elements up to the highly radioactive inventory of the nuclear-power plants in situ by self-driving via boreholes of a depth of, e.g. 15-20 km in historically manageable periods, with hermetic sealing from the biosphere and with high reduction of costs by fully automated sequences with shorter decay times, convince operators and the general public affected.

4. With the creation of final depositories at the main nuclear-power plant locations, the cost thereof is overall considerably lower than with a central final depository solution. At the same time, by burden-sharing, the problem is distributed over several locations, the resistance by the general public affected is reduced, since only the population at the nuclear facility locations is affected, and they have come to terms with nuclear energy anyway, and the risk and stress from the nuclear waste transports now no longer taking place are reduced.

5. The combination of direct final storage in situ with an integrated apparatus for controlling a reactor meltdown renders possible a substantial extension of the reactor runtimes and increases the acceptance of the final depository concept according to the invention among nuclear-power plant operators, politicians and the population of the locations affected.

6. Final storage in situ does not only bring relief from the population at the location in terms of risk and transport, but also creates jobs in the region with the construction of the final depository, which are guaranteed long-term by the complete dismantling of the nuclear facility. At the same time tax revenue is increased and guaranteed in the long term.

7. The acceptance by the general public with nuclear facilities for final depository locations in situ is achieved in particular by the self-driving of the highly radioactive material into the center of the earth never to return, since neither the region nor subsequent generations are left with an incalculable "evil inheritance," while to the contrary the generation that enjoys the advantages of nuclear energy also assumes the burden of disposal.

8. The advantages across society of final storage by self-driving at the nuclear locations in situ via extremely deep bores and the development of the metal melt drilling methods ready for implementation associated as a prerequisite therewith are substantially outmatched by the creation of a completely new multi-billion market from the new metal melt drilling method base technology, of which the safe final storage is only one of the applications.

9. In addition to the greatest possible safety, the time and cost factors are important arguments for a permanent depository in situ: the costs for a borehole, e.g. 20 km deep with a capacity of 1 $m^3$/m are estimated to be approx. € = 200 m. The drilling time with the continuously operating metal melt drilling method alone is about six months, so that the rest of the year remains for transport to and from, and thus per year a 20 km borehole can be completed ready for production with a drilling installation. For each deep borehole, for example, 5×1000 m final depository zones with a final depository volume of approx. 5000 $m^3$ can be used. With 24,000 $m^3$ highly radioactive, heat-generating waste for the nuclear-power plants currently in existence in Germany, five final depositories according to the invention would be necessary with a total investment of € 1 billion. This sum has already been invested in the construction of the Gorleben and Schacht Konrad locations, which turned out to be unsuitable as final depositories, and will have to be invested once again before they are usable as final depositories for low-level and medium-level radioactive material.

10. The cost of the search, testing and construction of a new central final depository to solve Germany's final depository problem will be at least twice as expensive according to current empirical values as the final depository solution in situ according to the invention, the cost of transport and the cost savings in dismantling the nuclear-energy facility not being included. The picture is similar with regard to the construction time scenario. For final depositories according to the invention, including the technical development of the magnetic slide metal melt drilling facilities up to technical readiness for use, a completion of 5 final depository shafts can be expected by 2020. The completion of a central final depository according to conventional mining methods, however, cannot be expected before 2030.

The invention claimed is:

1. A method of forming a permanent depository in a borehole for highly radioactive material, the method comprising the steps of:

forming in the borehole by metal fusion drilling a metal lining from a casting continuously formed from a metal melt and thereby forming the wall thickness of the metal lining of a lower borehole region such that the wall thickness increases from the top downward and a downward widening of the lower region;

depositing the highly radioactive material for final storage in the lower region of the lined borehole; and melting this lining locally immediately above this lower area after deposition of the material to separate the lower region holding the material from the rest of the lining and permit this lower region and the material held therein to migrate automatically downward toward the center of the earth, whereby the downward widening of the lower region converts lateral compressive forces on the lower region into a vertical downward thrust force that force the separated lower region downward into the earth.

2. The method according to claim 1 wherein the migration is supported by residual heat-generation of the highly radioactive material.

3. The method according to claim 1 wherein the borehole is sunk to such a depth that the rock pressure or the permanent weight under the force of gravity and or a rock melt formation from the hot deep-seated rock supports the migration.

4. The method according to claim 1 wherein the borehole for final storage is produced by self-driving directly in situ at a nuclear-power plant or an intermediate storage facility or other nuclear facilities.

5. The method according to claim 1, further comprising the step of:

filling a medium into free spaces between the stored material as heat transfer media or as moderator for fast neutrons to increase heat dissipation.

6. The method according to claim 1, further comprising the step of:

closing the filled lower borehole region by a pressure-resistant cover.

7. The method according to claim 6 wherein above the closed lower borehole region the cast-metal lining of the borehole is melted by a heat source on a magnetic slide melting apparatus and the lower borehole region is thus separated from the rest of the shaft, wherein the metal melt accruing during melting of the lining forms a pressure resistant plug atop the lower borehole region.

8. The method according to claim 1 wherein a partial melt formation occurring between the surrounding rock and the lining of the lower borehole region by residual heat production, autogenously generated heat of the deep-seated rock, lateral pressure of the rock, and the force of gravity on the separated lower borehole zone acts as a slide path between the hot deep-seated rock and the jacket of the final depository region and under lateral pressure of the rock or the effect of gravity on the separated lower borehole region accelerates downward migration of the separated lower region.

9. The method according to claim 8 wherein fluids dissolved in the partial melt formation follow or precede the hot lower borehole region in the migration into hotter regions of the earth's interior, whereby the safe disposal of the fluids pumped in is ensured and the migration is additionally accelerated.

10. The method according to claim 1, further comprising the steps of:

providing the upper portion of the borehole with a shaft plug of metal melt and thereafter filling a further lower borehole region.

11. The method according to claim 1 wherein not only the final storage of the highly radioactive inventory of a nuclear-power plant, but also the dismantling thereof with direct final storage of the accruing material is carried out in situ in one and the same borehole, such that a connection from a reactor building or reactor, or intermediate storage facility to the borehole is produced.

12. The method according to claim 1 wherein the radioactive material is deposited in the lower region of the lined borehole with a magnetic slide device.

13. The method according to claim 1 wherein a tunnel runs from a reactor to a low-lying basin lined with graphite ingot molds with overflow crucibles and lying in decay area of the reactor or of an intermediate storage facility, so that the highly radioactive melt runs into the basin, the reactor melt being directly deposited via an automated transport system into a lower borehole region as final depository.

* * * * *